US005217264A

United States Patent [19]

Fier

[11] Patent Number: 5,217,264

[45] Date of Patent: Jun. 8, 1993

[54] TWO-PIECE LOCK

[75] Inventor: Duane T. Fier, Hudson, Wis.

[73] Assignee: Andersen Corporation, Bayport, Minn.

[21] Appl. No.: 901,558

[22] Filed: Jun. 19, 1992

[51] Int. Cl.[5] ..... E05C 3/06

[52] U.S. Cl. ..... 292/142; 292/336.3; 292/240; 292/246

[58] Field of Search ..... 292/246, 5, 37, 49, 292/140, 142, 172, 173, 197, 244, DIG. 46, 240

[56] References Cited

U.S. PATENT DOCUMENTS

| | | | |
|---|---|---|---|
| 374,391 | 12/1887 | Born | 292/142 |
| 389,646 | 9/1888 | Gunniss . | |
| 800,043 | 9/1905 | Witte . | |
| 1,941,459 | 1/1934 | Bock | 292/142 |
| 2,019,664 | 2/1934 | Farmer | 292/332 |
| 2,746,098 | 5/1956 | Cooper et al. | 20/4 |
| 2,771,313 | 12/1954 | Blake | 292/142 |
| 3,201,161 | 8/1965 | Castle | 292/173 |
| 3,594,031 | 7/1971 | Ford | 292/140 |
| 3,762,750 | 10/1973 | Orr | 292/140 |
| 4,643,005 | 2/1987 | Logas | 292/DIG. 46 X |
| 5,092,640 | 3/1992 | Plummer | 292/197 X |

*Primary Examiner*—Richard E. Moore

*Attorney, Agent, or Firm*—Merchant, Gould, Smith, Edell, Welter & Schmidt

[57] ABSTRACT

A lock intended primarily for gliding or hinged doors or windows. The lock is an improvement over the prior art in that it is a very simple mechanism which nonetheless is secure and cannot be back-driven. The lock mechanism is made up of essentially two parts: a cam gear which is rotatably mounted on a housing and acts as an actuator, and a cam rack which is linearly slidable relative to the housing. Rotation of the cam gear causes the cam rack to move between an unlocked and a locked position. Once in the locked position, a gear tooth of the cam gear engages with a stop surface on the cam rack to prevent the cam rack from being back-driven.

25 Claims, 4 Drawing Sheets

TWO-PIECE LOCK

BACKGROUND OF THE INVENTION

The present invention relates generally to a lock mechanism of the type designed to prevent a gliding or hinged door or window from being opened. More particularly, the invention relates to such a mechanism which employs a two piece cam gear/cam rack assembly which both actuates the lock and prevents it from being backdriven.

U.S. patent application Ser. No. 689,296, filed on Apr. 22, 1991 (now U.S. Pat. No. 5,092,640, issued Mar. 3, 1992) and assigned to the same assignee as the present invention, discloses a latch mechanism which is particularly useful in combination with the lock mechanism of the present invention. To the extent that the disclosure of Ser. No. 689,296 is necessary for the understanding of the present invention, that application is herein incorporated by reference.

Various devices are known for locking a gliding or hinged door or window. A common and simple version of such a device has a housing attached to the window frame and a bolt slidably mounted within the housing. A keeper attached to the window sash is positioned to receive the bolt when the window is closed. Thus, the bolt can be moved from a retracted position, where the window can be opened, to a forward position, where the bolt engages the keeper and prevents the window from being opened.

In order to increase the force applied to the bolt so as to make it easier to move the bolt, it is known to provide a rotating actuator for the bolt. The actuator is rotatably mounted on the lock housing, and has at least one arm projecting therefrom. When the actuator is rotated, the arm engages the bolt, causing the bolt to slide into engagement with the keeper. An example of such a window lock is shown in U.S. Pat. No. 800,043 issued to White.

For security purposes, it is important when designing such a window or door lock that the lock cannot be back-driven. In other words, when the bolt is in the engaged position, it should not be able to be forced back into the retracted position by pressure against the bolt. One known lock mechanism which is designed so that it cannot be back-driven is shown in FIG. 1.

As shown in FIG. 1, the lock mechanism has a housing 80 which is designed to attach to one panel of a door or window (not shown). A base member 82 is slidably mounted within the housing. A bolt (not shown) is attached to the base member and positioned to engage a keeper (not shown) located on the door or window frame. An actuator 83 is rotatably mounted on the housing. The actuator is hingedly connected to the base member via arm 84 and link 85.

Rotation of the actuator in the clockwise direction causes the base member (and the bolt attached thereto) to slide linearly into the locked position. In this position, the linkage formed by arm 84 and link 85 is positioned over-center. By this arrangement, the lock mechanism cannot be back-driven, because any attempt to force the base member toward the unlocked position merely causes arm 84 to press harder against stop surface 86.

This lock suffers from several drawbacks. One, the linkage between the actuator and bolt is expensive to manufacture and assemble. The linkage also increases the size of the lock, because room must be provided for both the actuator arm and the link, and because enough space must be provided to allow the linkage to move over-center.

SUMMARY OF THE INVENTION

The present invention is a lock intended primarily for gliding or hinged doors or windows. The lock is an improvement over the prior art in that it is a very simple mechanism which nonetheless is secure and cannot be back-driven. The lock mechanism is made up of essentially two parts: a cam gear which is rotatably mounted on a housing and acts as an actuator, and a cam rack which is linearly slidable relative to the housing. A bolt is attached to the cam rack. The cam gear has a center gear tooth and at least one lateral gear tooth extending from a central hub. The cam rack has a centrally disposed engagement portion which is designed to receive the center gear tooth of the cam gear. The cam rack further has at least one lateral cam surface and lateral stop surface located adjacent thereto.

In use, the primary force for moving the cam rack is provided by the force of the center gear tooth against the engagement portion during rotation of the cam gear. However, when the cam gear has been rotated a predetermined amount, the lateral gear tooth comes into contact with the lateral cam surface located on the cam rack. The action of the lateral gear tooth against the lateral cam surface upon further rotation of the cam gear not only increases the force applied to move the cam rack, but also disengages the center gear tooth from the engagement portion. Once in the locked position, the lateral gear tooth engages the lateral stop surface, so as to prevent the cam rack, and hence the bolt attached to it, from being back-driven.

Preferably, the cam gear has two lateral gear teeth, one located on either side of the center gear tooth, and the cam rack has two sets of lateral cam surfaces and stop surfaces, each set being located generally on opposite sides of the central engagement portion. Such an arrangement allows for the lock to be bi-directional; i.e., from a central, unlocked position, the cam gear can be rotated either clockwise or counterclockwise so as to move the cam rack either direction into a locked position. Further, the cam gear and cam rack are dimensioned such that whichever direction the cam gear is rotated, when one of the lateral cam teeth engages a lateral stop surface so as to lock the cam rack in place, the other lateral cam tooth engages a side wall of the central engagement portion so as to prevent further rotation of the cam gear.

The preferred angle between the two lateral cam teeth is 90 degrees, so that the cam gear need only be rotated 45 degrees to move the cam rack from the central, unlocked position to either one of the locked positions. A handle is preferable provided which can releasably engage the hub of the cam gear in order to provide additional torque for rotating the cam gear.

DETAILED DESCRIPTION OF THE PREFERRED EMBODIMENT

The lock mechanism of the present invention is shown in FIG. 2–7 as being integrally formed with a latch mechanism of the type disclosed in U.S. application Ser. No. 689,296, which has been incorporated by reference. However, it is to be understood that the lock mechanism of the present invention need not be limited for use with the latch assembly shown in the preferred embodiment. It can be used by itself, or with some other type of latch mechanism.

Figure 1:
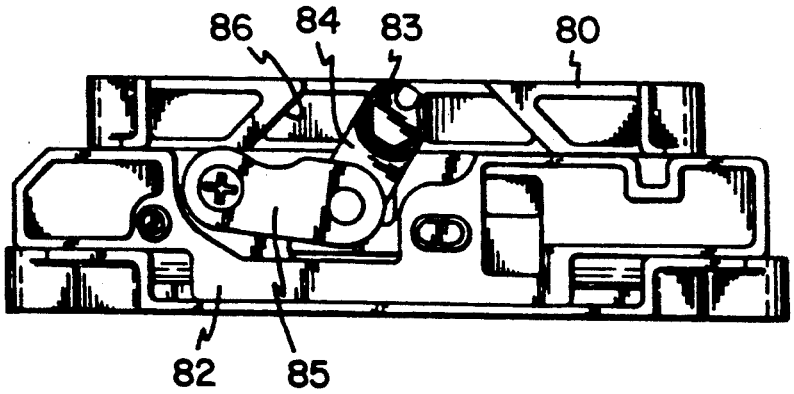
FIG. 1 PRIOR ART
FIG. 1 is a front view of a prior art locking mechanism.
Figure 2:
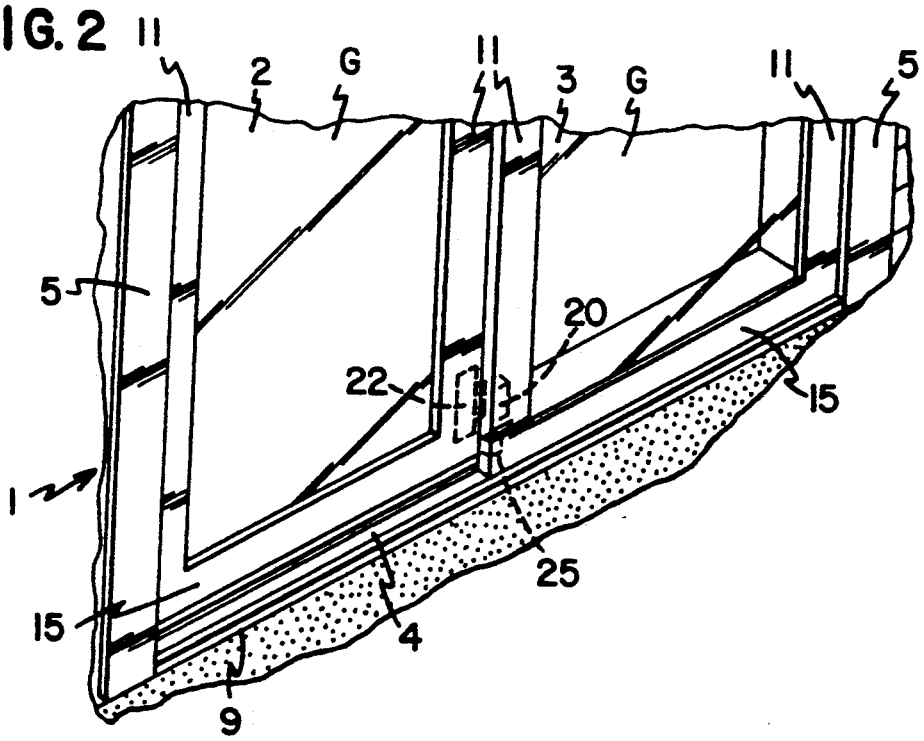
FIG. 2 is a perspective view of a portion of a gliding glass door o window upon which a latching and locking assembly made according to the preferred embodiment of the present/invention is mounted.

FIG. 2 shows a portion of a typical gliding glass door or window 1 upon which the latching and locking assembly of the preferred embodiment is mounted. Such gliding doors and windows are well-known in the art. They are generally made up of first and second panels 2 and 3. Each panel has two vertical sash members 11, a horizontal lower sash member 15, and a horizontal upper sash member (not shown) which together hold glass G in place. The panels are mounted within a frame consisting of vertical frame members 5, a horizontal lower frame member 9 and a horizontal upper frame member (not shown). A track 4 extending along the lower frame member 9 allows the panels 2 and 3 to slide so as to open or shut the window or door.

The locking and latching assembly of the preferred embodiment is designated as 20 in FIG. 2, and is attached to panel 3. A latch keeper 22 is mounted on panel 2. A lock keeper 25 is mounted on the lower frame member 9. As will be discussed in further detail, assembly 20 has a latch mechanism to engage the latch keeper 22 and thereby hold panels 2 and 3 together. The assembly further has a lock mechanism which engages the lock keeper 25 to hold the panels relative to the window frame.

Figure 3:
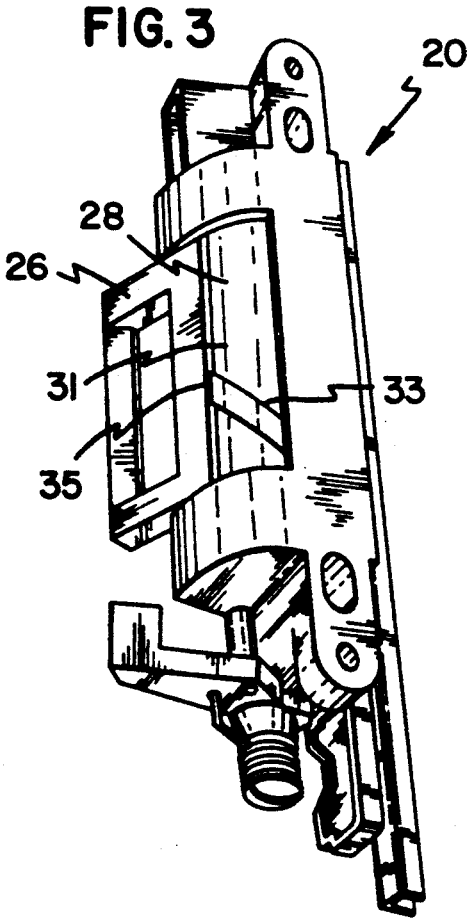
FIG. 3 is a perspective view of the assembly of FIG. 2, showing the latching mechanism in the unlatched position.
Figure 4:
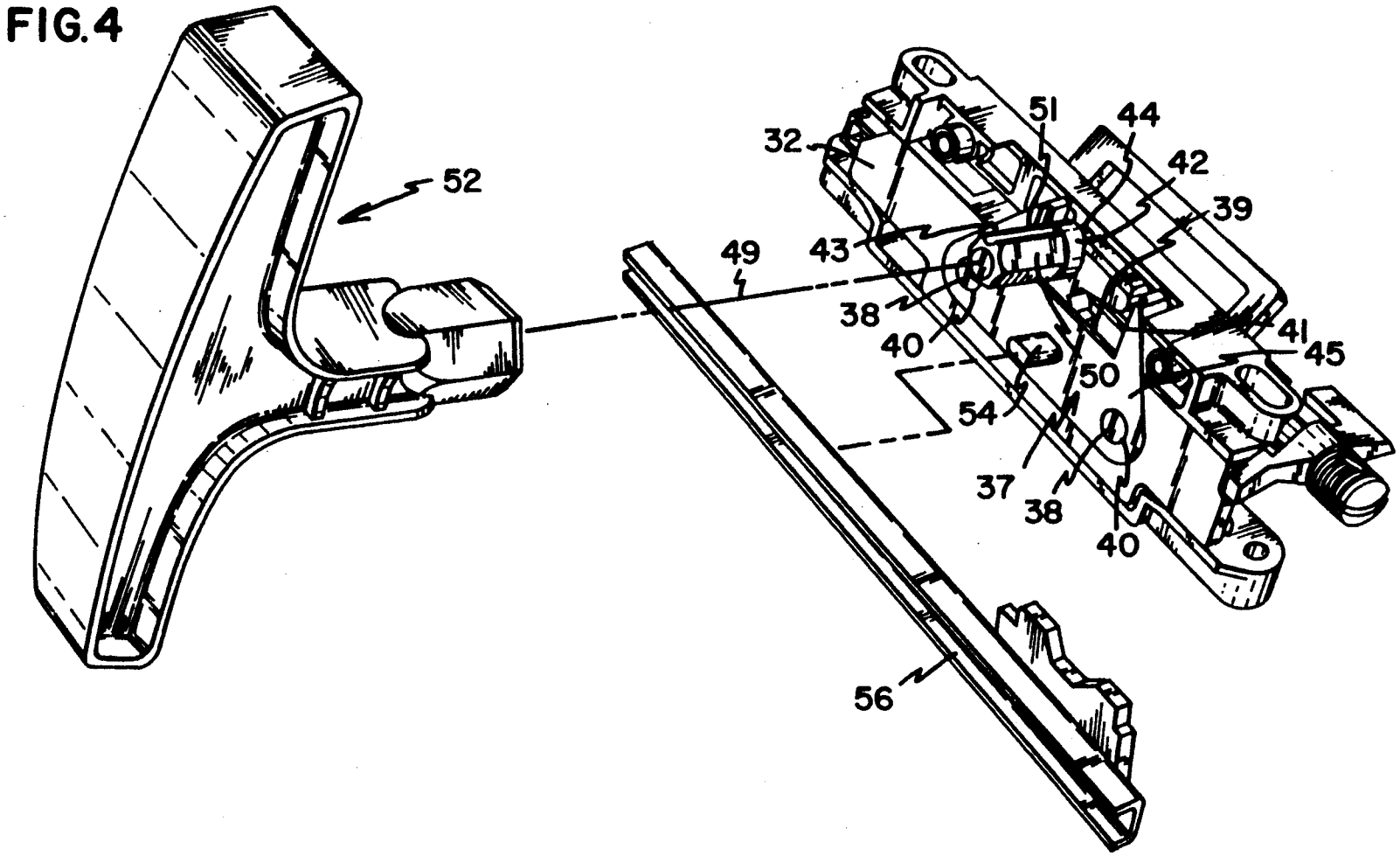
FIG. 4 is a perspective view of the assembly of FIG. 2, partially exploded, showing the locking mechanism in the unlocked position.

The latch mechanism of assembly 20 can be seen clearly in FIG. 3. This latch mechanism generally includes a latch member 26 and a half cylinder member 28 disposed within a housing 30. Half cylinder member 28 is slidable (vertically in FIG. 3) linearly within the housing and is made up of a half cylinder 31 integrally formed with a planar base member 32 (FIG. 4). A spiral ridge 33 extends around the outer surface of half cylinder 31. A corresponding spiral groove 35 located in latch member 26 engages the spiral ridge on the half cylinder. As described in greater detail in U.S. Ser. No. 689,296, in accordance with this design, vertical movement of half cylinder member 28 causes the latch member to rotate about a vertical axis. The latch member is thus rotatable between a position of engagement with latch keeper 22, wherein the window panels are latched together, and a free position wherein the panels are free to be opened.

The locking mechanism which constitutes the present invention is shown in FIG. 4. As seen therein, a cam rack 37 is mounted within a recess formed in the planar base member 32. Two posts 38 projecting from the recessed portion of base member 32 engage two openings 40 in the cam rack to aid in holding the base member and the cam rack together.

Figure 5:
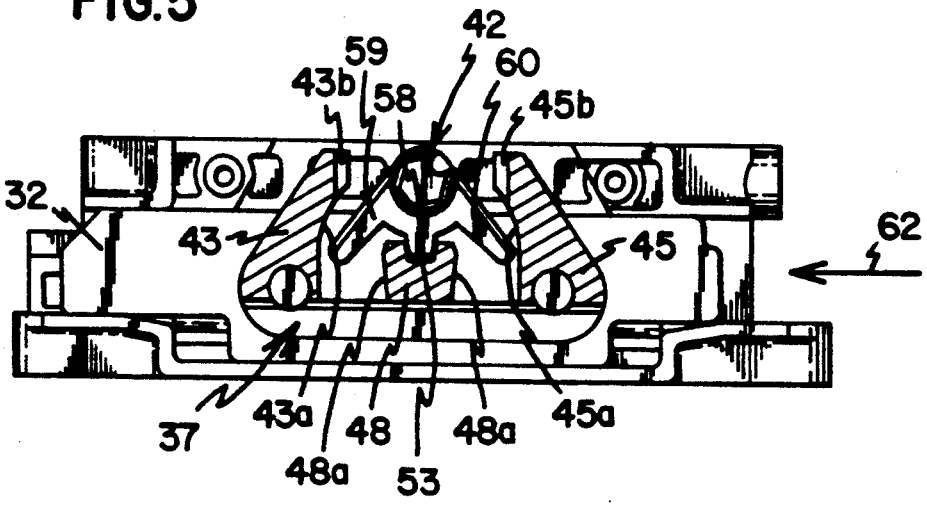
FIG. 5 is a cross-sectional view taken along lines 5—5 of FIG. 4.

Cam rack 37 is made of a front wall 39, back wall 41, and side walls 43 and 45 so as to define an open space within the cam rack. An engagement portion 48 extends between the front and back walls within the cam rack. As shown in FIG. 5, the engagement portion has two generally planar outer wall surfaces 48*a*, and a centrally-located U-shaped channel 53. Side walls 43 and 45 each define an angled cam surface 43*a* and 45*a*, and a stop surface 43*b* and 45*b*. The stop surfaces extend generally parallel to the outer wall surfaces 48*a*.

Cam rack 37 has a projection 54 located on one side of thereof. A bolt 56 has an opening which engages projection 54 so as to connect the cam rack and the bolt together. The bolt is positioned to selectively engage lock keeper 25 as will be hereinafter explained.

Partially located within the cam rack is a cam gear 42. Cam gear 42 has a short central gear tooth 58 and two longer lateral gear teeth 59 and 60. The angle between gear teeth 59 and 60 is preferably about 90 degrees, with a central gear tooth being located half way between the two lateral gear teeth. Cam gear 42 also has a cylindrical projecting pin 44. This pin engages an opening located in the housing so that the cam gear can rotate about axis 49. A hexagonal shaft 50 having a slot 51 extending therealong is also located on the cam gear. A removable handle 52 with a similar hexagon-shaped engagement portion is designed to engage shaft 50 so as to provide extra torque for rotation of the cam gear. As will be described in more detail with respect to FIGS. 5–7, the cam gear engages the cam rack so that upon rotation of the cam gear, the cam rack, as well as the planar base member and the bolt, are moved linearly.

The cam gear and cam rack are shown in the unlocked position in FIG. 5. Central gear tooth 58 of the cam gear is located within channel 53 of the engagement portion, while lateral gear teeth 59 and 60 are located within the cam rack on either side of the engagement portion. As the cam gear is rotated clockwise, central gear tooth 58 engages the engagement portion so as to move the cam rack (as well as base member 32 and bolt 56) linearly in the direction of arrow 62.

Figure 6:
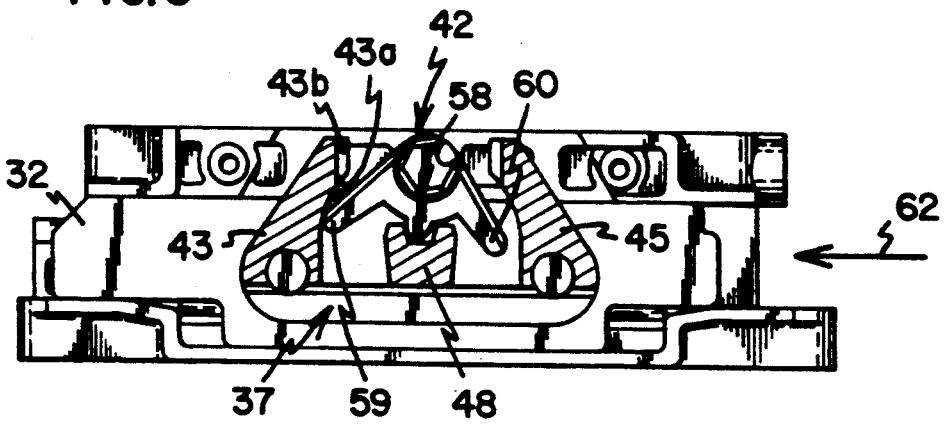
FIG. 6 is a cross-sectional view similar to FIG. 5, taken upon partial movement of the locking mechanism toward the locked portion.

This motion continues until lateral gear tooth 59 contacts cam surface 43*a*, as shown in FIG. 6. The interaction between gear tooth 59 and cam surface 43*a* upon further rotation of the cam gear has two results. One, the force of gear tooth 59 against the cam surface adds to the lateral force applied by the cam gear against the cam rack. This aids movement of the cam rack toward the locked position. Two, as the rack moves to the locked position, central gear tooth 58 is lifted out of engagement with the engagement portion.

Figure 7:
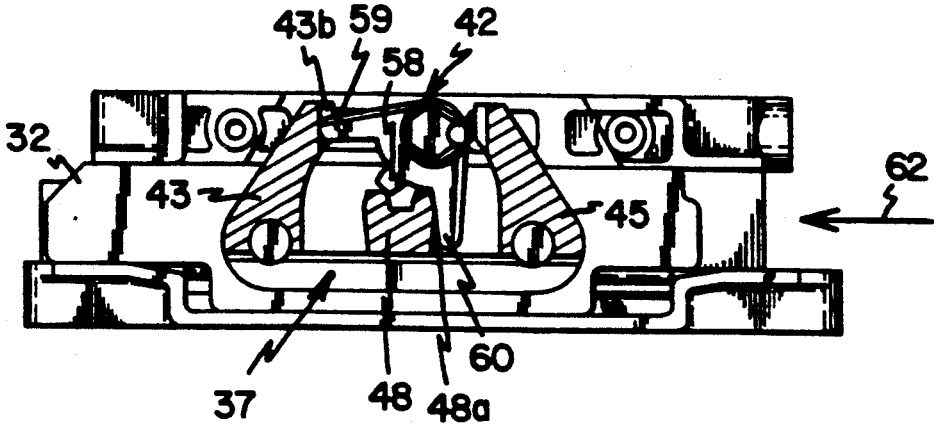
FIG. 7 is a cross-sectional view similar to FIG. 5, showing the locking mechanism is the locked position.

The cam gear and rack are shown in the locked position is FIG. 7. In this position, bolt 56 has engaged with the lock keeper 25 so as to lock the gliding door or window panel relative to the frame member 9. In the locked position, gear tooth 60 of the cam gear contacts the outer wall surface 48*a* of the engagement portion to prevent further rotation of the cam gear in the clockwise direction. Further, the end of gear tooth 59 engages stop surface 43*b* so as to prevent the cam rack from being back-driven. Particularly, force applied against the cam rack in the direction opposite to that of arrow 62, for example when an unauthorized person attempts to force bolt 56 out of engagement with keeper 25, causes the stop surface 43*b* to press harder against gear tooth 59. Since the cam gear cannot move linearly with respect to the housing, such force will not cause backward movement of the rack.

To disengage the lock mechanism, the cam gear is merely rotated from the position of FIG. 7 to that of FIG. 5. Such rotation causes gear tooth 59 to disengage from stop surface 43*b* and reengage cam surface 43*a*. Upon further rotation in the counter clockwise direction, first the cooperation of gear tooth 59 and cam surface 43, and then the cooperation of central gear tooth 58 and engagement portion 48, causes the cam rack to move linearly in the direction opposition to arrow 62.

The lock mechanism of the present invention is bidirectional. That is, the cam gear can also be rotated counter clockwise from the unlocked position of FIG. 6, and the cam gear will move to a locked position, this time with gear tooth 60 engaging cam surface 45*a* and stop surface 45*b*.

Furthermore, because the cam rack is connected to planar base member 32, rotation of the cam gear also causes latch member 26 of the latching assembly to move in and out of the latched position. Thus, according to the preferred embodiment, the locking and latching functions are performed simultaneously simply by rotating the cam gear.

In the preferred embodiment, the cam gear, cam rack, and bolt are all made of sturdy metal material like steel, while the housing, handle and keeper can be contructed of plastic materials such as acetal or reinforced nylon. Other suitable materials can be used.

While the invention has been described with reference to the preferred embodiment, it must be understood that various changes and modifications are possible without departing from the spirit and scope of the invention. In particular, the locking mechanism of the present invention has been shown together with a separate latching mechanism. Such is not necessary. All that is required is that the cam rack be somehow mounted so as to be slidable linearly within the housing. Also, the lock keeper need not be attached to the frame, but can be attached to the other door or window panel. Furthermore, the shape, size, and arrangement of the various parts can be changed. Thus, the scope of the patent should be defined not with reference to the preferred embodiment, but to the following claims.

I claim:

1. A lock, comprising:

a housing;

a cam gear pivotably mounted on said housing, said cam gear having a first lateral gear tooth and a center gear tooth; and a cam rack slidable linearly relative to said housing, said cam rack having a centrally disposed engagement portion, a first lateral cam surface, and a first lateral stop surface located adjacent said first lateral cam surface;

wherein rotation of said cam gear in one direction causes said cam rack to slide between an unlocked position and a first locked position;

wherein upon initial rotation of said cam gear in said one direction, said center gear tooth engages said engagement portion, causing said cam rack to slide toward the first locked position, and upon further rotation of said cam gear in said one direction, said first lateral gear tooth engages said first lateral cam surface, causing said cam rack to slide into the first locked position; and wherein when said cam rack is in the first locked position, said first lateral gear tooth engages said first lateral stop surface to prevent the cam rack from being moved back to the unlocked position.

2. The lock as claimed in claim 1, wherein said further rotation of said cam gear in said one direction also causes said center gear tooth to disengage from said engagement portion.

3. The lock as claimed in claim 1, wherein said cam gear further comprises a second lateral gear tooth located on an opposite side of said center gear tooth relative to said first lateral gear tooth.

4. The lock as claimed in claim 3, wherein said engagement portion comprises an outer wall, and wherein when said cam rack is in the first locked position, said second lateral gear tooth engages said outer wall to prevent further rotation of said cam gear in said one direction.

5. The lock as claimed in claim 3, wherein said cam rack further comprises a second lateral cam surface located on an opposite side of said engagement portion relative to said first lateral cam surface and a second lateral stop surface located adjacent to the second lateral cam surface.

6. The lock as claimed in claim 5, wherein rotation of said cam gear in a second direction opposite to said one direction causes said cam rack to slide between an unlocked position and a second locked position;

wherein upon initial rotation of said cam gear in said second direction, said center gear tooth engages said engagement portion, causing said cam rack to slide toward the second locked position, and upon further rotation of said cam gear in the second direction, said second lateral gear tooth engages said second lateral cam surface, causing said cam rack to slide into the second locked position; and wherein when said cam rack is in the second locked position, said second lateral gear tooth engages said second lateral stop surface to prevent the cam rack from being moved back to the unlocked position.

7. The lock as claimed in claim 6, wherein said further rotation of said cam gear in said second direction also causes said center gear tooth to disengage from said engagement portion.

8. The lock as claimed in claim 6, wherein said engagement portion comprises first and second opposing outer walls, wherein when said cam rack is in the first locked position, said second lateral gear tooth engages said first outer wall to prevent further rotation of said cam gear in said one direction, and wherein when said cam rack is in the second locked position, said first lateral gear tooth engages said second outer wall to prevent further rotation of said cam gear in said second direction.

9. The lock as claimed in claim 5, wherein the angle between said first and second lateral gear teeth is approximately 90 degrees.

10. The lock as claimed in claim 1, further comprising means for rotating said cam gear.

11. The lock as claimed in claim 6, further comprising means for rotating said cam gear.

12. The lock as claimed in claim 1, wherein said lock is mounted on a window or door, said lock further comprising a bar attached to said cam rack, wherein said bar engages with a keeper located on a window or door frame so as to lock said window or door.

13. A lockable door or window, comprising:

a frame;

first and second panels disposed within said frame, said panels being movable between an open position and a closed position;

a lock housing attached to said first panel;

a cam gear pivotably mounted on said housing, said cam gear having a first lateral gear tooth and a center gear tooth; and a cam rack slidable linearly relative to said housing, said cam rack having a centrally disposed engagement portion and a first lateral cam surface;

wherein rotation of said cam gear in one direction causes said cam rack to slide between an unlocked position and a first locked position; and wherein upon initial rotation of said cam gear in said one direction, said center gear tooth engages said engagement portion, causing said cam rack to slide toward the first locked position, and upon further rotation of said cam gear in said one direction, said first lateral gear tooth engages said first lateral cam surface, causing said cam rack to slide into the first locked position.

14. The lock as claimed in claim 13, wherein said cam rack further comprises a first lateral stop surface located adjacent said first lateral cam surface, and wherein when said cam rack is in the first locked position, said first lateral gear tooth engages said first lateral stop surface to prevent the cam rack from being moved back to the unlocked position.

15. The door or window as claimed in claim 14, further comprising a bolt attached to said cam rack and a keeper positioned to receive said bolt when the panels are in the closed position;

wherein when the panels are in the closed position, said bolt engages the keeper in the first locked position and does not engage the keeper in the unlocked position.

16. The door or window as claimed in claim 15, wherein said keeper is mounted on said frame.

17. The door or window as claimed in claim 15, wherein said keeper is mounted on said second panel.

18. The lock as claimed in claim 13, wherein said further rotation of said cam gear in said one direction also causes said center gear tooth to disengage from said engagement portion.

19. The lock as claimed in claim 13, wherein said cam gear further comprises a second lateral gear tooth located on an opposite side of said center gear tooth relative to said first lateral gear tooth.

20. The lock as claimed in claim 19, wherein said engagement portion comprises an outer wall, and wherein when said cam rack is in the first locked position, said second lateral gear tooth engages said outer wall to prevent further rotation of said cam gear in said one direction.

21. The lock as claimed in claim 19, wherein said cam rack further comprises a second lateral cam surface located on an opposite side of said engagement portion relative to said first lateral cam surface and a second lateral stop surface located adjacent to the second lateral cam surface.

22. The lock as claimed in claim 21, wherein rotation of said cam gear in a second direction opposite to said one direction causes said cam rack to slide between an unlocked position and a second locked position;

wherein upon initial rotation of said cam gear in said second direction, said center gear tooth engages said engagement portion, causing said cam rack to slide toward the second locked position, and upon further rotation of said cam gear in the second direction, said second lateral gear tooth engages said second lateral cam surface, causing said cam rack to slide into the second locked position; and wherein when said cam rack is in the second locked position, said second lateral gear tooth engages said second lateral stop surface to prevent the cam rack from being moved back to the unlocked position.

23. The lock as claimed in claim 22, wherein said engagement portion comprises first and second opposing outer walls, wherein when said cam rack is in the first locked position, said second lateral gear tooth engages said first outer wall to prevent further rotation of said cam gear in said one direction, and wherein when said cam rack is in the second locked position, said first lateral gear tooth engages said second outer wall to prevent further rotation of said cam gear in said second direction.

24. The lock as claimed in claim 19, wherein the angle between said first and second lateral gear teeth is approximately 90 degrees.

25. The lock as claimed in claim 13, further comprising means for rotating said cam gear.

* * * * *